US010613452B2

(12) United States Patent
Naiki et al.

(10) Patent No.: US 10,613,452 B2
(45) Date of Patent: Apr. 7, 2020

(54) IMAGE FORMING APPARATUS AND PROGRAM

(71) Applicant: KONICA MINOLTA, INC., Chiyoda-ku, Tokyo (JP)

(72) Inventors: Shigeki Naiki, Toyokawa (JP); Teppei Kunihisa, Toyokawa (JP); Soh Hirota, Toyokawa (JP); Hironori Akashi, Okazaki (JP); Kenji Tsuru, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/268,376

(22) Filed: Feb. 5, 2019

(65) Prior Publication Data

US 2019/0278197 A1 Sep. 12, 2019

(30) Foreign Application Priority Data

Mar. 7, 2018 (JP) ..... 2018-040647

(51) Int. Cl.
*G03G 15/00* (2006.01)
*G03G 15/08* (2006.01)

(52) U.S. Cl.
CPC ..... *G03G 15/0848* (2013.01); *G03G 15/5058* (2013.01)

(58) Field of Classification Search
CPC ..... G03G 15/0848; G03G 15/50; G03G 15/5054; G03G 15/5058; G03G 2215/00029; G03G 2215/00059
See application file for complete search history.

(56) References Cited

U.S. PATENT DOCUMENTS

2015/0362878 A1* 12/2015 Nagashima ..... G03G 15/5054 399/49
2016/0131991 A1* 5/2016 Yoshida ..... G03G 15/5058 399/49
2017/0269527 A1* 9/2017 Kaneko ..... G03G 15/5058

FOREIGN PATENT DOCUMENTS

JP 2011-039105 A 2/2011
JP 2014-132318 A 7/2014

* cited by examiner

*Primary Examiner* — Sophia S Chen
(74) *Attorney, Agent, or Firm* — Squire Patton Boggs (US) LLP

(57) ABSTRACT

An image forming apparatus includes: an image forming part that forms a toner image on a recording medium; and a hardware processor that controls the image forming part, wherein the image forming part includes an image carrier, the hardware processor executes: a first adjustment process of adjusting the image forming part with use of a first image formation condition determined in accordance with a toner adhesion amount at a plurality of points in a first direction on the image carrier; and a second adjustment process of adjusting the image forming part with use of a second image formation condition determined in accordance with a toner adhesion amount at one point in a first direction on the image carrier, the image carrier rotates as a recording medium is conveyed, the first direction is a direction intersecting with a rotational direction of the image carrier.

10 Claims, 13 Drawing Sheets

(2) STARTING POINT OF TONER ADHESION AMOUNT ADJUSTMENT ··· FIRST TONER ADHESION AMOUNT ADJUSTMENT UPON REPLACEMENT IS SET AS STARTING POINT

IMAGE FORMING APPARATUS AND PROGRAM

The entire disclosure of Japanese patent Application No. 2018-040647, filed on Mar. 7, 2018, is incorporated herein by reference in its entirety.

BACKGROUND

Technological Field

The present disclosure relates to adjustment of a toner adhesion amount in an image forming apparatus.

Description of the Related Art

In an image forming apparatus adopting a roller charging system, a film on an outside of a photoreceptor is worn as the apparatus is used. This wear can be suppressed by transfer of a lubricant contained in toner to the photoreceptor. If an amount of the transfer of the lubricant to the photoreceptor is not constant in a main scanning direction, an inclination may occur in the wear of the film thickness of the photoreceptor in the main scanning direction.

An image forming apparatus uses one image density control (IDC) sensor for each color to be printed, for controlling a toner adhesion amount. The IDC sensor is realized by, for example, a reflective photosensor. More specifically, the image forming apparatus causes the IDC sensor to detect a toner adhesion amount adjustment pattern formed on an intermediate transfer belt, and adjusts an adhesion amount of each color toner with use of the detection result.

As described above, there may be a case where an inclination occurs in the wear of the film thickness in the main scanning direction. On the other hand, JP 2014-132318 A proposes a technique of appropriately correcting an adhesion amount by arranging a plurality of IDC sensors in a main scanning direction, reading a same toner adhesion amount adjustment pattern to calculate an average value of an inclination of each development characteristic, and adjusting image formation conditions such as development potential and charging bias on the basis of the calculation result.

Further, in a part that is not a detection target by the IDC sensor, a toner adhesion amount is not adjusted even if the photoreceptor is worn. This may cause an actual toner adhesion amount to fall below a target adhesion amount range. In such a case, a low toner density may be conspicuous in a formed image. On the other hand, for example, JP 2011-39105 A proposes a technique of arranging a plurality of IDC sensors in a main scanning direction. In this technique, deviations from respective target values are detected by reading a correction pattern with use of the plurality of IDC sensors, and a density is stabilized by using the IDC sensor with a larger deviation for density correction.

However, in the technique proposed in JP 2014-132318 A, increasing the number of the IDC sensors to be used for adjusting a toner adhesion amount and using toner adhesion amounts at many points require a long time for detection and analyzation of the result, creating a new problem of prolonging a time required for adjustment.

Further, in the technique proposed in JP 2011-39105 A, an IDC sensor having a larger deviation is used for density correction. Therefore, when an inclination of wear is large in the main scanning direction of the photoreceptor, the toner adhesion amount may not always be appropriately corrected.

SUMMARY

The present disclosure has been devised in view of such circumstances, and it is an object to shorten a time required for adjustment while utilizing a detection result of a toner adhesion amount at a plurality of points for adjusting the toner adhesion amount, to appropriately correct a toner adhesion amount in a main scanning direction of a photoreceptor.

To achieve the abovementioned object, according to an aspect of the present invention, an image forming apparatus reflecting one aspect of the present invention comprises: an image forming part that forms a toner image on a recording medium; and a hardware processor that controls the image forming part, wherein the image forming part includes an image carrier, forms a toner image on the image carrier, and firms a toner image on the recording medium by transferring an image on the image carrier onto the recording medium, the hardware processor executes: a first adjustment process of adjusting the image forming part with use of a first image formation condition determined in accordance with a toner adhesion amount at a plurality of points in a first direction on the image carrier; and a second adjustment process of adjusting the image forming part with use of a second image formation condition determined in accordance with a toner adhesion amount at one point in a first direction on the image carrier, the image carrier rotates as a recording medium is conveyed, the first direction is a direction intersecting with a rotational direction of the image carrier, in the first adjustment process, the first image formation condition is determined as a condition for realizing a given toner adhesion amount, and a specific target adhesion amount is determined as a toner adhesion amount at the one point when the image forming part is adjusted in accordance with the first image formation condition, in the second adjustment process, the second image formation condition is determined as a condition for setting a toner adhesion amount at the one point to the specific target adhesion amount, and at a time of arrival of timing at which the image forming part is to be adjusted, the hardware processor executes the first adjustment process when a predetermined condition is satisfied, and executes the second adjustment process when the predetermined condition is not satisfied.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
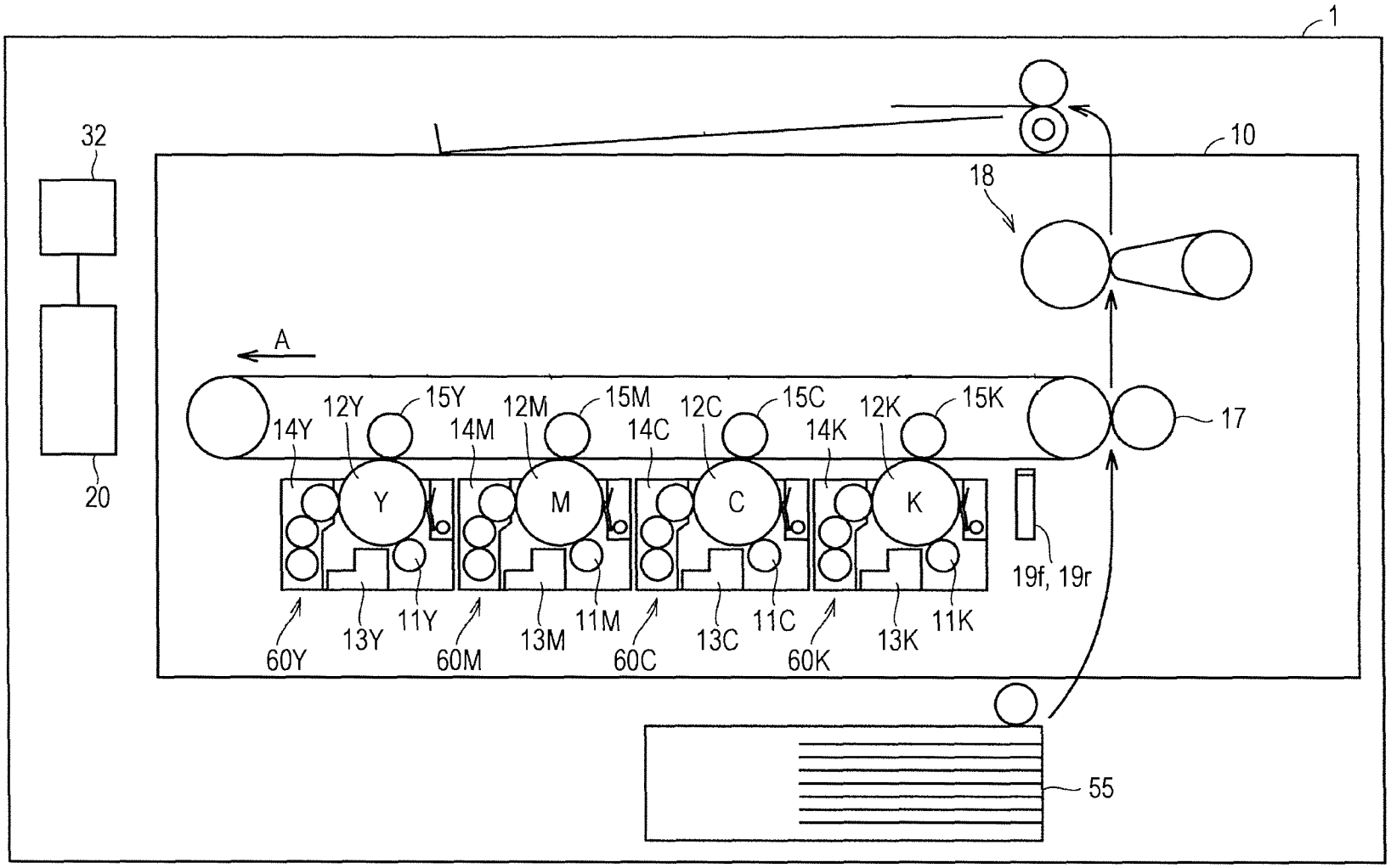
FIG. 1 shows an outline of a configuration of an image forming apparatus according to an embodiment of the present disclosure.

Hereinafter, one or more embodiments of the present invention will be described with reference to the drawings. However, the scope of the invention is not limited to the disclosed embodiments. In the following description, the same reference numerals are used for the same parts and constituent parts. Their names and functions are also the same. Therefore, explanations for those will not be repeated.

[1] Configuration of Image Forming Apparatus

FIG. 1 shows an outline of a configuration of an image forming apparatus 1 according to an embodiment of the present disclosure. As shown in FIG. 1, the image forming apparatus 1 includes an image processing part 10, a control part 20, and a scanner 32.

The image processing part 10 forms an image using toner of four colors (yellow, magenta, cyan, and black). In the image processing part 10, a constituent part with "Y" after the reference number is involved in formation of a yellow toner image. Similarly, a constituent part with "M" after the reference number is involved in formation of a magenta toner image, a constituent part with "C" after the reference number is involved in formation of a cyan toner image, and a constituent part with "K" after the reference number is involved in formation of a black toner image.

The image processing part 10 includes charging rollers 11Y to 11K, photoreceptors 12Y to 12K, exposure devices 13Y to 13K, developing devices 14Y to 14K, first transfer rollers 15Y to 15K, an intermediate transfer belt 16, a second transfer roller 17, a fixing device 18, and IDC sensors (reflective photosensors) 19*f* and 19*r*. The charging rollers 11Y to 11K, the photoreceptors 12Y to 12K, the exposure devices 13Y to 13K, and the developing devices 14Y to 14K form image forming units 60Y to 60K.

An arrow A indicates a rotational direction of the intermediate transfer belt 16. Among the IDC sensors 19*f* and 19*r*, the IDC sensor 19*f* is arranged on a front side of FIG. 1. The IDC sensor 19*r* is arranged on a rear side in FIG. 1. Note that the arrow A indicates a sub scanning direction of an image formed on a sheet, and a direction intersecting with the arrow A (direction passing through FIG. 1) indicates a main scanning direction of the image. In this sense, the IDC sensors 19*r* and 19*f* are arranged at different positions in the main scanning direction.

The respective photoreceptors 12Y to 12K are charged by the respective charging rollers 11Y to 11K. Thereafter, by being subjected to exposure corresponding to image data by the respective exposure devices 13Y to 13K, respective surfaces of the photoreceptors 12Y to 12K are formed with an electrostatic latent image corresponding to the image data. The formed electrostatic latent images are developed by receiving toner of respective colors of yellow (Y), magenta (M), cyan (C), and black (K) from the developing devices 14Y to 14K. A sheet in a paper feeding cassette 55 is led to the second transfer roller 17. The developed toner images of the respective colors are sequentially transferred onto the intermediate transfer belt 16 by the first transfer rollers 15Y to 15K. Thereafter, the toner images are collectively transferred onto a sheet, and are further fixed by the fixing device 18. As a result, a printed image with an optimal color is formed on the sheet.

At a time of executing first toner adhesion amount adjustment and second toner adhesion amount adjustment, which will be described later, the IDC sensors 19*f* and 19*r* detect a reflection density of a toner pattern formed of toner images with setting of a plurality of developing biases Vdc, and output a detection result to the control part 20.

Here, a reflection density D is derived in accordance with the following expression (1), where lo is an amount of light projected onto a detection target, and 1 is an amount of reflected light from the detection target.

$$D=-\log I/Io \quad (1)$$

FIG. 1 shows an intermediate transfer body and peripheral parts thereof for execution of image formation according to a horizontal tandem system, but is not intended to limit the configuration and arrangement of each element for the photoreceptor, a charger, exposure, development, transfer, fixing, and the like. The image forming apparatus according to an embodiment of the present disclosure may adopt other configuration or arrangement.

[2] Configuration of Control Part 20

Figure 2:
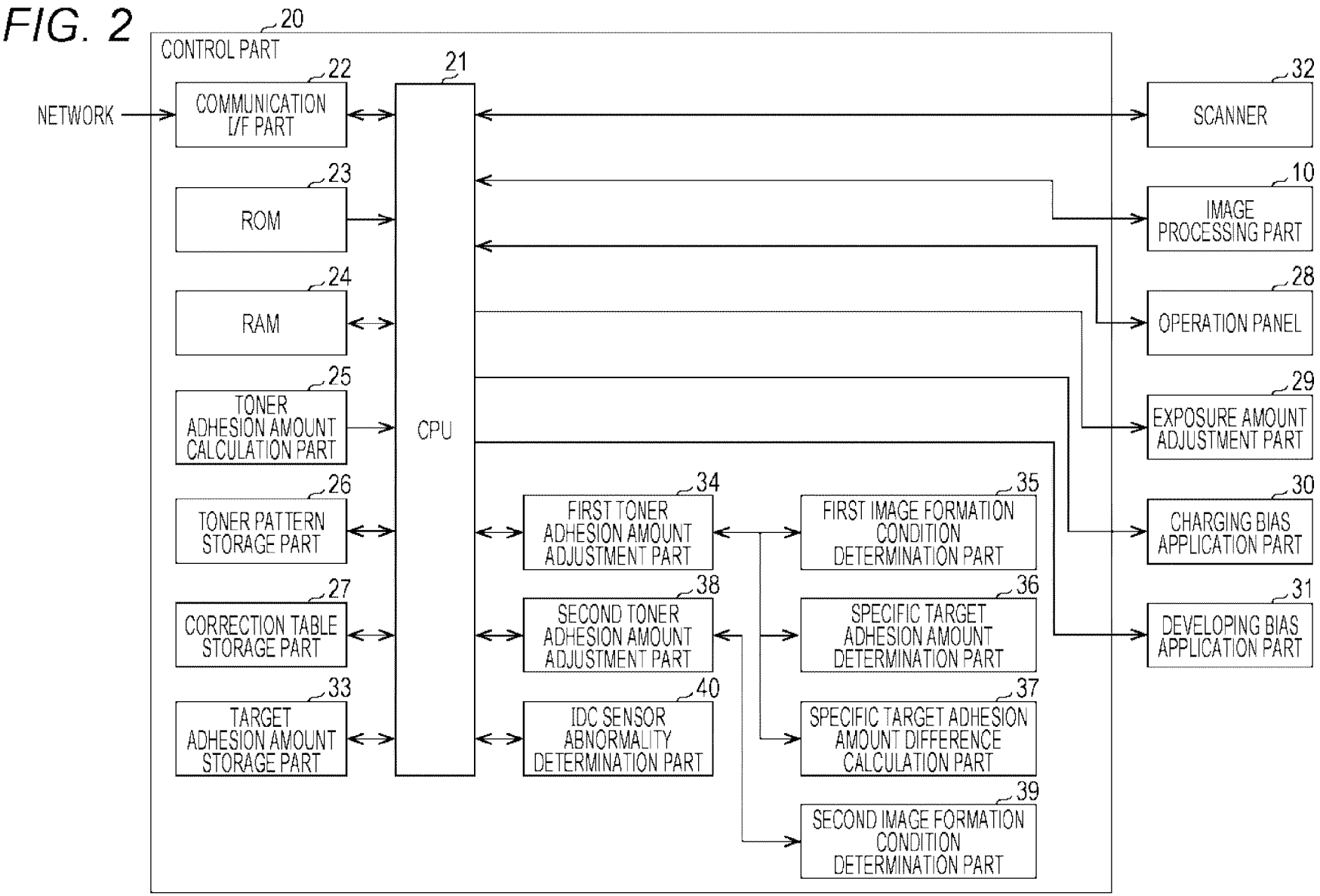
FIG. 2 is a diagram showing a configuration of a control part of the image forming apparatus.

FIG. 2 is a diagram showing a configuration of the control part 20 of the image forming apparatus 1. As shown in FIG. 2, the control part 20 includes a central processing part (CPU) 21, a communication interface (I/F) part 22, a read only memory (ROM) 23, a random access memory (RAM) 24, a toner adhesion amount calculation part 25, a toner pattern storage part 26, a correction table storage part 27, and a target adhesion amount storage part 33 to be used for the first toner adhesion amount adjustment and the second toner adhesion amount adjustment to be described later. The toner adhesion amount calculation part 25 is realized by, for example, the CPU 21 executing a given program. The toner pattern storage pan 26, the correction table storage part 27, and the target adhesion amount storage part 33 are realized by, for example, a storage device such as a hard disk.

The control part 20 further includes a first toner adhesion amount adjustment part 34, a first image formation condition determination part 35, a specific target adhesion amount determination part 36, a specific target adhesion amount difference calculation part 37, a second toner adhesion amount adjustment part 38, a second image formation condition determination part 39, an IDC sensor abnormality determination part 40, and the like. At least one of the first toner adhesion amount adjustment part 34, the first image formation condition determination part 35, the specific target adhesion amount determination part 36, the specific target adhesion amount difference calculation part 37, the second toner adhesion amount adjustment part 38, the second image formation condition determination part 39, or the IDC sensor abnormality determination part 40 is realized by, for example, the CPU 21 executing a given program.

The communication I/F part 22 is an interface to connect to a local area network (LAN), such as a LAN card or a LAN board. In addition to a program required for controlling the image processing part 10, an operation panel 28, an exposure amount adjustment part 29, a charging bias application part 30, a developing bias application part 31, and the like, the ROM 23 stores a program for executing the first toner adhesion amount adjustment and the second toner adhesion amount adjustment to be described later, and the like. The CPU 21 reads out and executes each program stored in the ROM 23. The RAM 24 is used as a work area of the CPU 21 at a time of program execution.

The operation panel 28 includes a plurality of input keys and a liquid crystal display part. On a surface of the liquid crystal display part, a touch panel is laminated. Onto the operation panel 28, an instruction from a user is inputted as a touch input from the touch panel or a key input from the input keys. The operation panel 28 notifies the control part 20 of the instruction.

The exposure amount adjustment part 29 adjusts an exposure amount of respective colors by adjusting light amounts of light sources for exposure of the respective colors of yellow (Y), magenta (M), cyan (C), and black (K) of the exposure devices 13Y to 13K. The charging bias application part 30 applies a charging bias to the charging rollers 11Y to 11K. The developing bias application part 31 applies a developing bias to the developing devices 14Y to 14K.

The toner adhesion amount calculation part 25 calculates a toner adhesion amount on the basis of a reflection density of a toner pattern inputted from each of the IDC sensors 19*f* and 19*r*. In one example, the ROM 23 stores a table indicating a relationship between a reflection density and a toner adhesion amount. By referring to the table, the toner adhesion amount calculation part 25 calculates a toner adhesion amount corresponding to a reflection density detected by the IDC sensors 19*f* and 19*r*.

The toner pattern storage part 26 stores data of an image including a toner pattern (e.g., "first sample image" in FIG. 4 to be described later) and an image formation condition for forming the image. One example of the image formation condition is an exposure amount of the exposure devices 13Y to 13K. Another example is a charging bias to be applied to the charging rollers 11Y to 11K. Still another example is a developing bias (voltage) to be applied to the developing device. Yet another example is a combination of these conditions. In one example, the ROM 23 stores an image formation condition corresponding to each of one or more of target toner adhesion amounts (hereinafter referred to as "target adhesion amount").

The correction table storage part 27 stores a toner adhesion amount and an exposure amount, a toner adhesion amount and a charging bias, and a toner adhesion amount and a developing bias.

[3] Operation Flow

Figure 3:
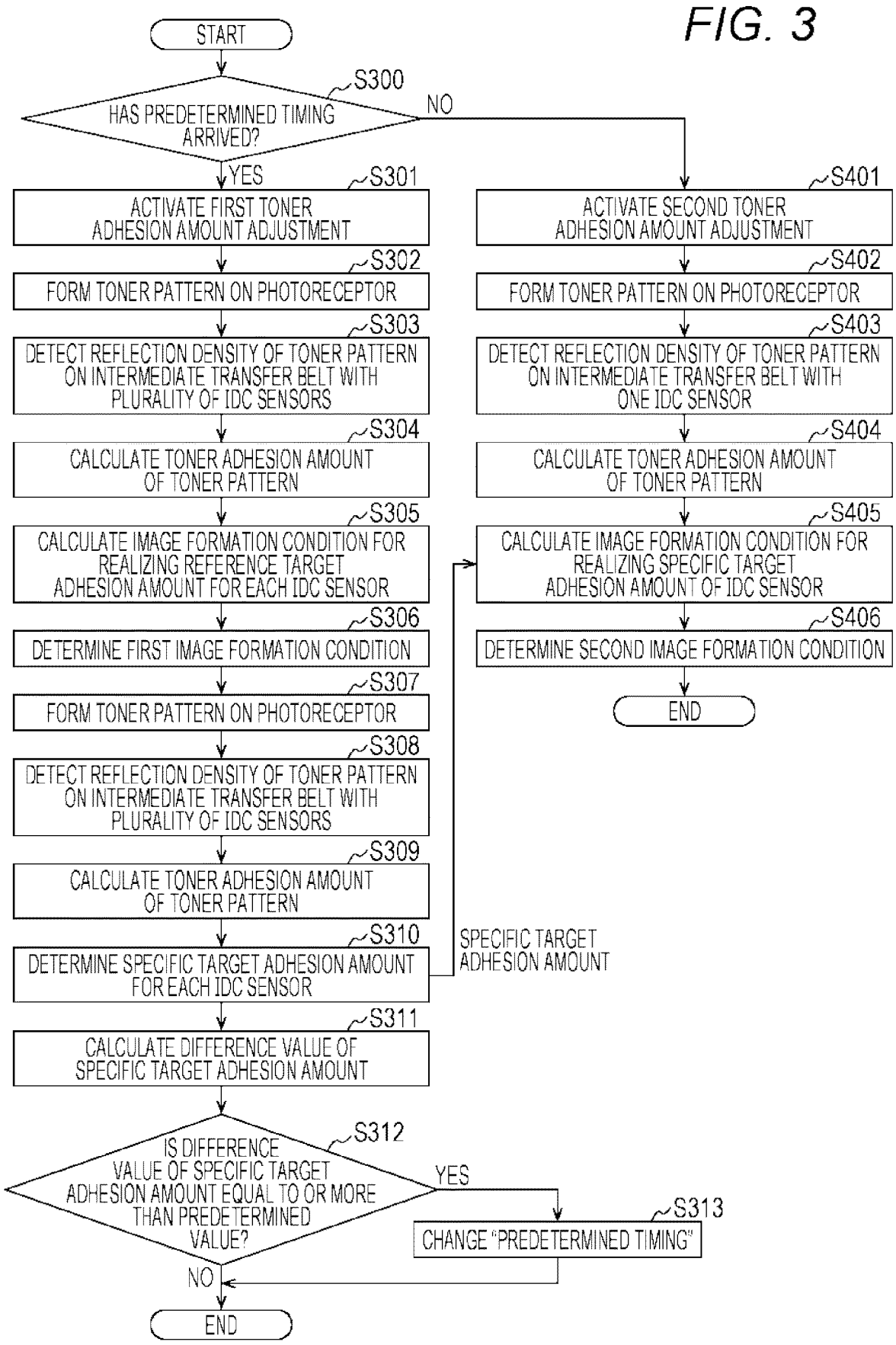
FIG. 3 is a flowchart showing a flow of operations of a "first toner adhesion amount adjustment process" and a "second toner adhesion amount adjustment process" to be executed by the control part.

FIG. 3 is a flowchart showing a flow of operations of a "first toner adhesion amount adjustment process" and a "second toner adhesion amount adjustment process" to be executed by the control part 20. These operations are realized by, for example, the CPU 21 executing a given program. The program is stored in the ROM 23, for example. The control part 20 starts processing of FIG. 3 each time a certain number of images are formed in the image forming apparatus 1, for example. Note that the control part 20 may start the processing of FIG. 3 at fixed time intervals.

In step S300, the control part 20 determines whether or not a predetermined timing has arrived. Upon determining that the predetermined timing has arrived (YES in step S300), the control part 20 advances the control to step S301, or otherwise (NO in step S300) advances the control to step S401.

Hereinafter, the "first toner adhesion amount adjustment process" will be described as steps S301 to S313, and the "second toner adhesion amount adjustment process" will be described as steps S401 to S406. Yet another example of the predetermined tinting is that the control has proceeded from step S300 to step S401 for a predetermined number of times after the control has proceeded from the previous step S300 to step S301. For example, in a case where the predetermined timing is that the control has proceeded from step S300 to step S401 for three times after the control has proceeded from step S300 to step S301, when the processing of FIG. 3 is executed for four times, the control proceeds from step S300 to step S301 one time out of the four times, and the control proceeds from step S300 to step S401 for three times out of the four times.

[3-1] First Toner Adhesion Amount Adjustment Process

In step S301, the control part 20 activates the first toner adhesion amount adjustment part 34 that performs the first toner adhesion amount adjustment process.

In step S302, the control part 20 (first toner adhesion amount adjustment part 34) reads toner pattern data for toner adhesion amount adjustment and an image formation condition specified for forming an image of the toner pattern, from the toner pattern storage part 26 through the first image formation condition determination part 35. Then, the control part 20 (first toner adhesion amount adjustment part 34) causes the image processing part 10 to form an image of the read toner pattern on the photoreceptors 12Y to 12K, under the read image formation condition. The image including the toner pattern formed in step S302 is referred to as "first sample image".

Figure 4:
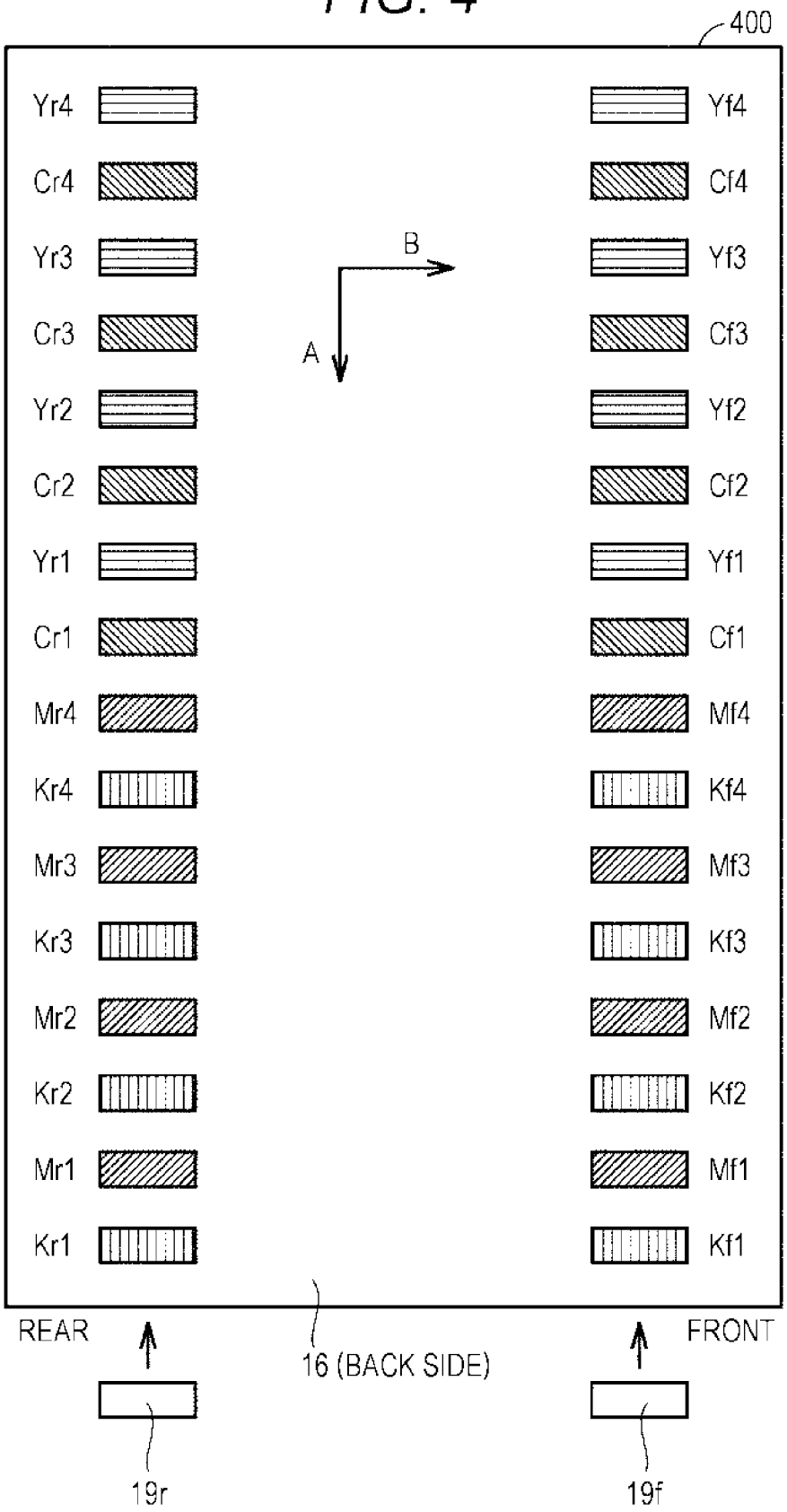
FIG. 4 is a view showing one example of a first sample image.

FIG. 4 is a view showing one example of the first sample image. In FIG. 4, an arrow A indicates a direction in which a first sample image 400 moves with a rotation of the intermediate transfer belt 16, which is one example of a sub scanning direction. An arrow B is a direction intersecting with the arrow A, which is one example of a main scanning direction.

The first sample image 400 includes sixteen toner patterns arranged along the direction of the arrow A, and includes two toner patterns arranged along the direction of the arrow B. That is, the first sample image 400 includes 32 toner patterns.

In FIG. 4, a character string formed of three letters such as "Yr4" is given to each toner pattern. These character strings are given to distinguish each toner pattern and are not included in an actual first sample image. The first letter indicates a color (yellow (Y), magenta (M), cyan (C), or black (K)) of an image to be formed.

The second letter indicates arrangement in the main scanning direction on the intermediate transfer belt 16. The letter "f" indicates a position that can be detected by the IDC sensor 19*f* arranged on the front side. The letter "r" indicates a position that can be detected by the IDC sensor 19*r* arranged on the rear side.

The third letter indicates a density of printing. In the example of FIG. 4, the printing density is expressed in four stages of "1" to "4", in which the density "4" represents the darkest color and the density "1" represents the lightest color.

At a top of the first sample image 400 in FIG. 4, a toner pattern with "Yr4" is shown on the left side and a toner pattern with "Yf4" is shown on the right side. These toner patterns have a same color and density and differ in arrangement alone. Similarly, in the first sample image 400, each of adjacent toner patterns in the direction of the arrow B has a same color and density as the other toner pattern, and differs in arrangement alone.

In the first sample image 400, for each of the four colors, toner patterns to be printed with respective four types of densities are arranged in the direction of the arrow A. Further, in the direction of the arrow B, toner patterns to be printed with a same color and a same density are arranged.

Returning to FIG. 3, in step S303, the control part 20 (first image formation condition determination part 35) reads each toner pattern of the first sample image 400 formed on the intermediate transfer belt 16, with use of the IDC sensors 19*f* and 19*r*. The IDC sensors 19*f* and 19*r* detect reflection densities of the toner images of the respective toner patterns, and input to the control part 20.

In step S304, the control pan 20 (toner adhesion amount calculation pan 25) calculates a toner adhesion amount (t ($g/m^2$)) of each toner pattern on the basis of the detected reflection density.

In step S305, the control pan 20 determines an image formation condition corresponding to a reference target adhesion amount, for the toner adhesion amount calculated for each IDC sensor.

In step S306, the control part 20 determines the first image formation condition, with use of the image formation condition determined in step S305. In one example, the control part 20 determines the first image formation condition for a region on the rear side in accordance with the image formation condition determined for the IDC sensor 19*r*, and determines the first image formation condition for a region on the front side in accordance with the image formation condition determined for the IDC sensor 19*f*. Even in a case where an inclination of wear is large in the main scanning direction of the photoreceptor, a toner adhesion amount can be appropriately corrected over the entire region in the main scanning direction of the photoreceptor. In another example, the control part 20 determines the first image formation condition as an average value of the image formation condition determined for the IDC sensor 19*r* and the image formation condition determined for the IDC sensor 19*f*.

Figure 5:
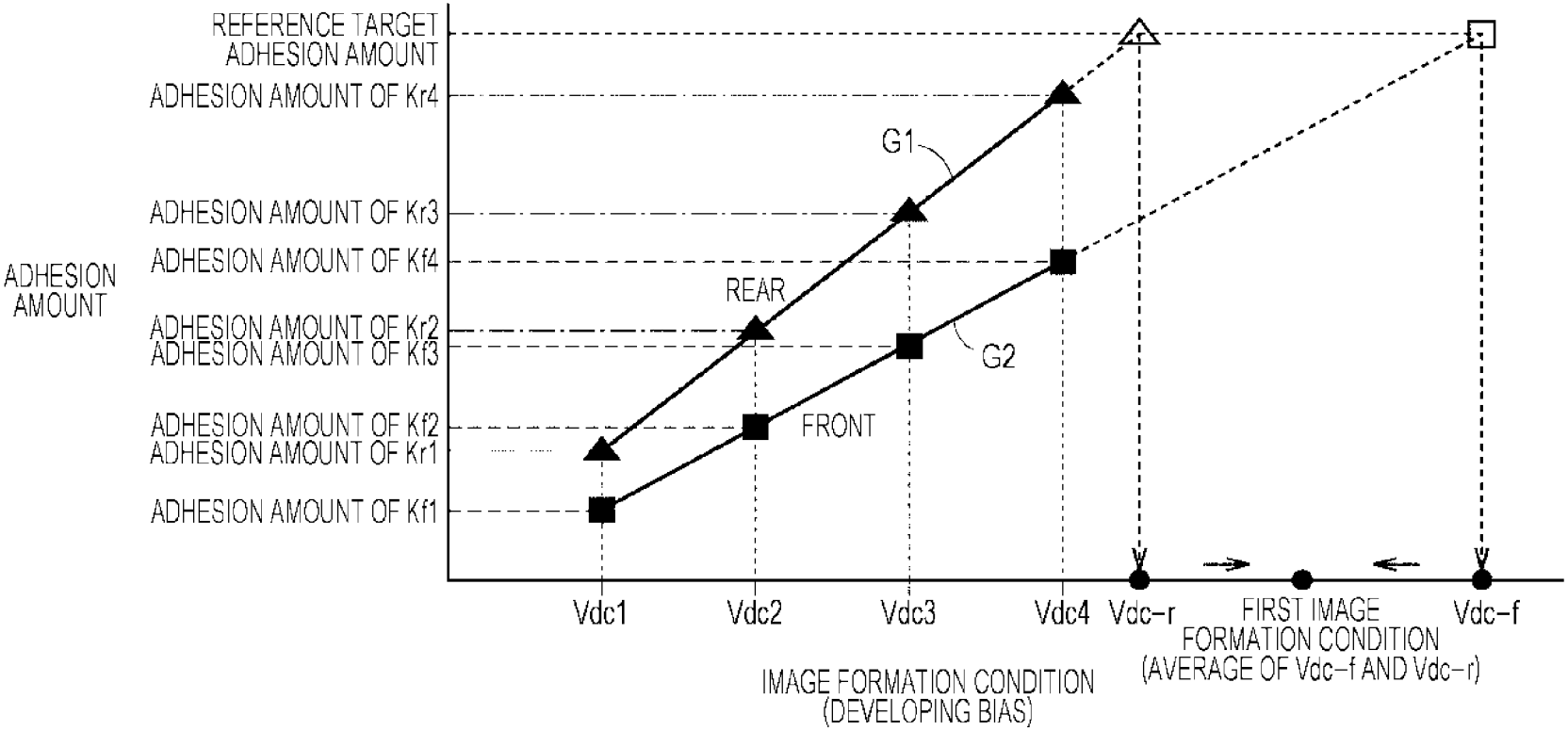
FIG. 5 is a graph for explaining one example of determination of a first image formation condition with use of detection results of an IDC sensor and an IDC sensor.

FIG. 5 is a graph for explaining one example of determination of the first image formation condition with use of detection results of the IDC sensor 19*r* and the IDC sensor 19*f*. With reference to FIG. 5, control contents in steps S305 and S306 will be described in more detail. To facilitate explanation, FIG. 5 shows information of one color (black: K) alone among four colors used for image formation in the image forming apparatus 1.

The example in FIG. 5 shows a relationship among the eight toner patterns (Kr1 to Kr4 and Kf1 to Kf4) of K (black) in the first sample image shown in FIG. 4. In FIG. 5, a horizontal axis indicates a value of a developing bias (a value of a voltage applied between an electrode of the developing device 14 and the photoreceptor 12K in forming a toner pattern), which is one example of the image formation condition, while a vertical axis indicates a toner adhesion amount detected by the IDC sensor 19*r* or the IDC sensor 19*f*. In the example of FIG. 5, the developing bias when each of the toner patterns Kr1 to Kr4 is formed is indicated by each of Vdc1 to Vdc4. Further, the developing bias when each of the toner patterns Kf1 to Kf4 is formed is indicated by each of Vdc1 to Vdc4.

The graph of FIG. 5 includes two lines G1 and G2. The line G1 indicates one example of an approximate expression of a relationship between adhesion amounts of the four toner patterns Kr1 to Kr4 and the image formation condition. Reflection densities of the toner patterns Kr1 to Kr4 are detected by the IDC sensor 19*r* arranged on the rear side. The line G2 indicates one example of an approximate expression of a relationship between adhesion amounts of the four toner patterns Kf1 to Kf4 and the image formation condition. Reflection densities of the toner patterns Kf1 to Kf4 are detected by the IDC sensor 19*f* arranged on the front side.

The "reference target adhesion amount" in FIG. 5 indicates a reference target adhesion amount referred to by the control part 20 in step S305 of FIG. 3. In step S305, the control part 20 uses the line G1 to determine the image formation condition (Vdc-r) corresponding to the reference target adhesion amount on the rear side in the main scanning direction. Further, the control part 20 uses the line G2 to determine the image formation condition (Vdc-f) corresponding to the reference target adhesion amount on the front side in the main scanning direction. Then, the control part 20 determines the "first image formation condition" as an average value of Vdc-r and Vdc-t:

The control part 20 uses the first image formation condition determined in step S306 to adjust an image formation condition to be used as a reference for image formation in the image forming apparatus 1. For this adjustment, for example, the target adhesion amount storage part 33 stores a reference image formation condition as the image formation condition corresponding to the reference target adhesion amount. The control part 20 compares the first image formation condition determined as described above and the reference image formation condition, and uses a result of the comparison to determine a coefficient to be applied to the image formation condition associated with the target toner adhesion amount. In one example, the control part 20 calculates a ratio of the first image formation condition to the reference image formation condition. Then, in the image formation, the control part 20 adjusts the toner adhesion amount by using, for each of the toner patterns Kr1 to Kr4 and Kf1 to Kf4, a value obtained by multiplying each of the preset developing biases Vdc1 to Vdc4 by the ratio.

Returning to FIG. 3, in step S307, the control part 20 (first toner adhesion amount adjustment part 34) reads toner pattern data for toner adhesion amount adjustment and the first image formation condition, from the toner pattern storage part 26 through the specific target adhesion amount determination part 36, and causes the image processing part 10 to form a sample image on the intermediate transfer belt 16 under the first image formation condition.

Figure 6:
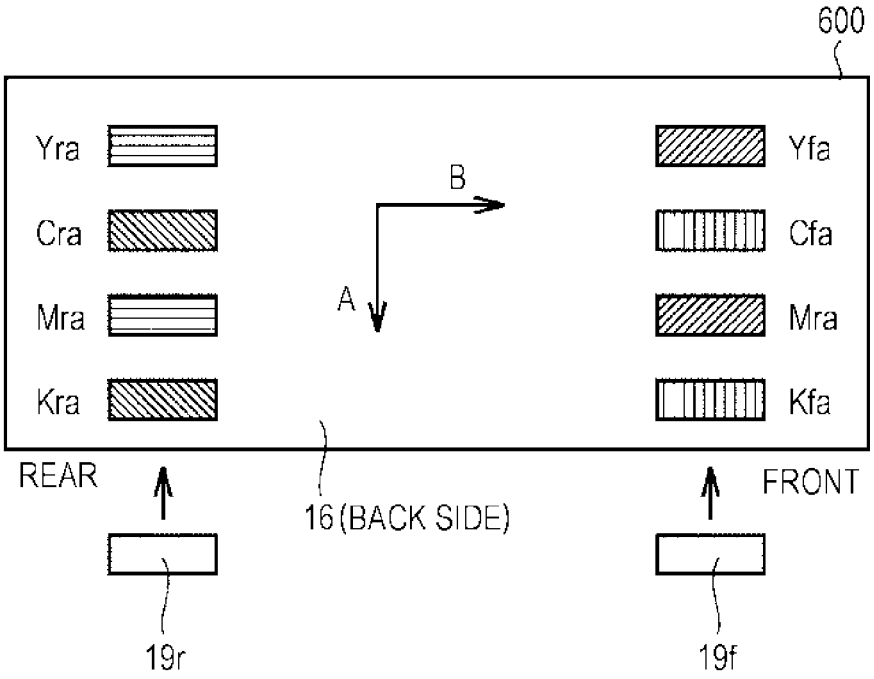
FIG. 6 is a view showing one example of a sample image formed on an intermediate transfer belt under the first image formation condition.

FIG. 6 is a view showing one example of a sample image formed on the intermediate transfer belt 16 under the first image formation condition. A sample image 600 of FIG. 6 includes a toner pattern arranged on the rear side and a toner pattern arranged on the front side for each color, that is, two toner patterns for four colors, which is a total of eight toner patterns. In FIG. 6 as well, similarly to FIG. 4, a character string formed of three letters is given to each toner pattern. The first letter indicates a color (Y, M, C, or K), and the second letter indicates arrangement (the rear side (r) or the front side (f)). The third letter (a) indicates that each toner pattern is formed in accordance with the first image formation condition.

Returning to FIG. 3, in step S308, the control part 20 (specific target adhesion amount determination part 36) causes the IDC sensors 19*f* and 19*r* to detect reflection densities of the respective toner patterns in the sample image (FIG. 6) formed in step S307. In step S309, on the basis of the reflection density detected in step S308, the control part 20 (specific target adhesion amount determination part 36) calculates a toner adhesion amount (t ($g/m^2$)) of each toner pattern.

In step S310, the control part 20 (specific target adhesion amount determination part 36) determines the toner adhesion amount calculated in step S309 as the specific target adhesion amount. In step S310, the specific target adhesion amount is determined for each IDC sensor for each color. Then, the control part 20 stores the determined specific target adhesion amount in the target adhesion amount storage part 33.

Figure 7:
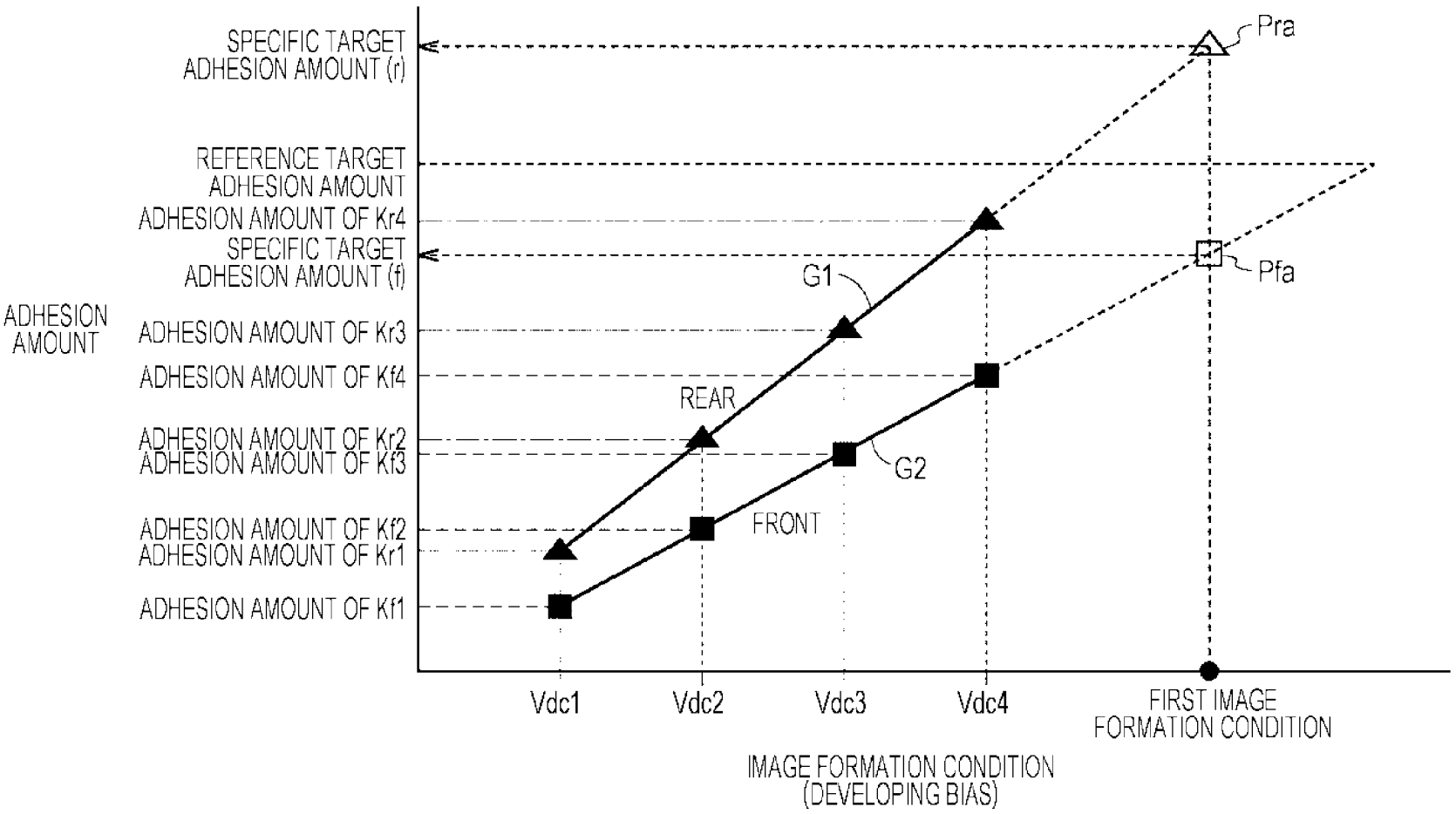
FIG. 7 is a graph showing one example of a specific target adhesion amount.

FIG. 7 is a graph showing one example of the specific target adhesion amount. FIG. 7 shows information of one color (black: K) alone among the four colors with which images are formed in the image forming apparatus 1.

In FIG. 7, a point Pra indicates a detection value of an adhesion amount corresponding to Kra (one toner pattern arranged on the rear side among two black toner patterns) of the sample image in FIG. 6. A point Pfa indicates a detection value of an adhesion amount corresponding to Kfa (one toner pattern arranged on the front side among two black toner patterns) of the sample image in FIG. 6. The adhesion amount of the point Pra is stored in the target adhesion amount storage part 33 as a specific target adhesion amount (r) for black. The adhesion amount of the point Pfa is stored in the target adhesion amount storage part 33 as a specific target adhesion amount (f) for black.

Lines G1 and G2 in FIG. 7 indicate the lines G1 and G2 in FIG. 5. The point Pra is generally located on an extended line of the line G1. The point Pfa is generally located on an extended line of the line G2. As a modification using these relationships, instead of the control of steps S307 to S309, the control part 20 may determine the specific target adhesion amount by using the lines G1 and G2 based on the toner adhesion amount calculated in step S304. That is, the line G1 may be extended to determine the specific target adhesion amount as the adhesion amount corresponding to the first image formation condition.

Meanwhile, shapes of the lines G01 and G2 are not limited to straight lines. That is, the control part 20 may generate a quadratic or higher approximate expression as an approximate expression representing the relationship between the toner adhesion amount calculated in step S304 and the image formation condition. Regardless of what kind of approximate expression is generated, instead of the control of steps S307 to S309, the control part 20 can use the approximate expression and the first image formation condition to determine the specific target adhesion amount, and store the specific target adhesion amount in the target adhesion amount storage part 33.

Returning to FIG. 3, in step S311, the control part 20 calculates a difference value between the specific target adhesion amounts determined in step S310 for respective IDC sensors (a difference value between the specific target adhesion amount determined for the IDC sensor 19*r* and the specific target adhesion amount determined for the IDC sensor 19*f*). This difference value corresponds to a difference value between the specific target adhesion amount (r) and the specific target adhesion amount (f) in FIG. 7.

In step S312, the control part 20 determines whether or not the difference value calculated in step S311 is equal to or more than a predetermined value. Upon determining that the difference value is equal to or more than the predetermined value (YES in step S312), the control part 20 advances the control to step S313, or otherwise ends (NO in step S312) the processing of FIG. 3.

In step S313, the control part 20 changes the "predetermined timing" in step S300 so as to increase a frequency for advancing the control from step S300 to step S301. For example, the predetermined timing is changed from "timing at which the processing of FIG. 3 is executed for the first time after at least one of the photoreceptors 12Y to 12K has been replaced" to "timing at which the processing of FIG. 3 is executed for the first time after at least one of the photoreceptors 12Y to 12K has been replaced, 'or after the intermediate transfer belt 16 has been replaced'". Thereafter, the control pan 20 ends the processing of FIG. 3.

When the difference value of the toner adhesion amounts of the toner patterns formed in accordance with a common image formation condition increases between the front side and the rear side under the control of steps S311 and S312 described above, the control part 20 increases the frequency for advancing the control from step S300 to step S301 instead of step S401.

The control part 20 starts the processing of FIG. 3, for example, every time a fixed number of images are formed and/or at fixed time intervals. When the predetermined timing has arrived, the control part 20 advances the control from step S300 to step S301 to execute the first toner adhesion adjustment process. When the predetermined timing has not arrived, the control part 20 advances the control from step S300 to step S401 to execute the second toner adhesion adjustment process. When the difference value becomes large, after the processing of FIG. 3 is started, the control part 20 changes the condition relating to the predetermined timing so as to increase a frequency for executing the first toner adhesion adjustment process.

[3-2] Second Toner Adhesion Amount Adjustment Process

In step 401, the control part 20 activates the second toner adhesion amount adjustment part 38 that performs the second toner adhesion amount adjustment.

In step S402, the control part 20 (second toner adhesion amount adjustment part 38) reads toner pattern data for toner adhesion amount adjustment and an image formation condition specified for forming an image of each toner pattern, from the toner pattern storage part 26 through the second image formation condition determination part 39. Then, the second toner adhesion amount adjustment part 38 causes the image processing part 10 to form the read toner pattern on the photoreceptors 12Y to 12K, under the read image formation condition. An image including the toner pattern formed in step S402 is referred to as "second sample image".

Figure 8:
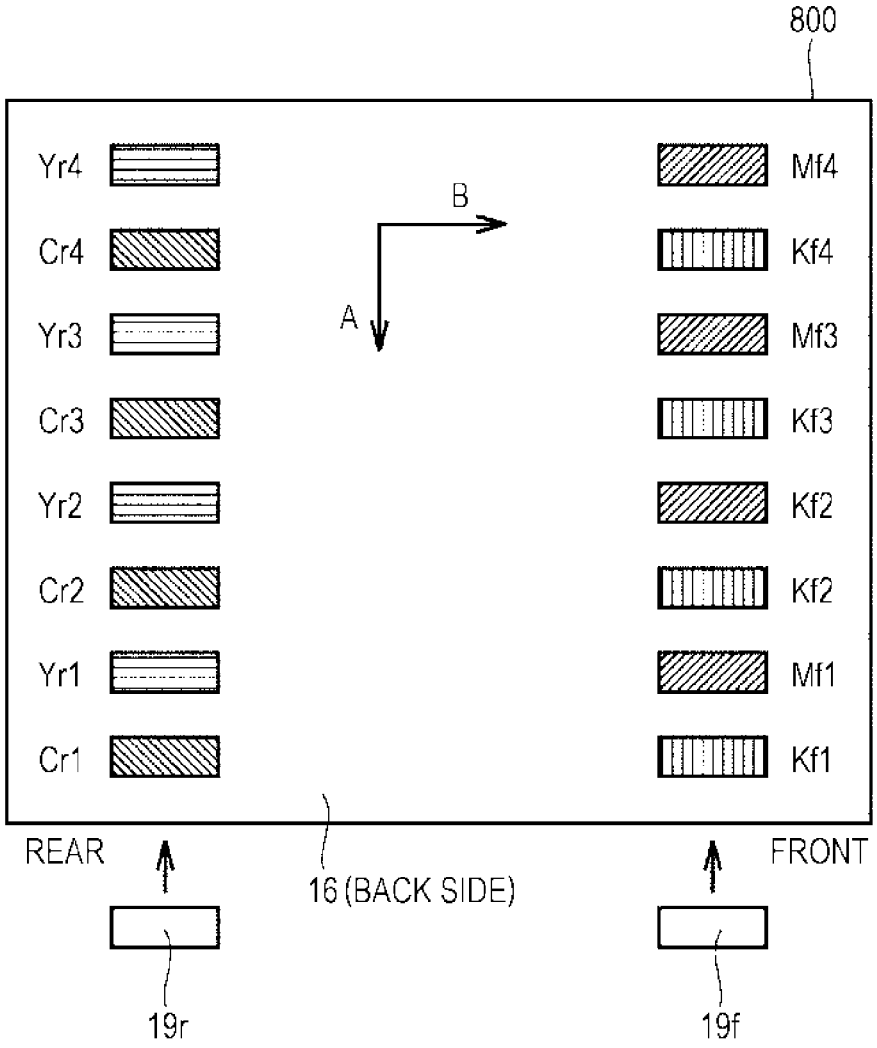
FIG. 8 is a view showing one example of a second sample image.

FIG. 8 is a view showing one example of the second sample image. A second sample image 800 includes eight toner patterns arranged along a direction of an arrow A (sub scanning direction), and includes two toner patterns arranged along a direction of an arrow B (main scanning direction). That is, the second sample image 800 includes sixteen toner patterns.

The sixteen toner patterns include eight toner patterns (Yr1 to Yr4, Cr1 to Cr4) at positions to be detected by the IDC sensor 19*r*, and eight toner patterns (Mf1 to Mf4, Kf1 to Kf4) at positions to be detected by the IDC sensor 19*f*.

Returning to FIG. 3, in step S403, the control part 20 (second image formation condition determination part 39) reads each toner pattern of the second sample image 800 formed on the intermediate transfer belt 16, with use of the IDC sensors 19*f* and 19*r*. The IDC sensors 19*f* and 19*r* detect reflection densities of the toner images of the respective toner patterns, and input to the control part 20. Note that, in step S403, for each color, the reflection density is detected exclusively by either one of the IDC sensor 19*f* or the IDC sensor 19*r*. More specifically, in the second sample image, the black (K) toner patterns (Kf1 to Kf4) include ones arranged on the IDC sensor 19*f* side, but do not include ones arranged on the IDC sensor 19*r* side. Therefore, for the black (K) toner pattern, the reflection density is detected by the IDC sensor 19*f* alone.

In step S404, on the basis of the reflection density detected in step S403, the control part 20 (toner adhesion amount calculation part 25) calculates a toner adhesion amount (t (g/m$^2$)) of each toner pattern.

In step S405, the control part 20 generates an approximate expression from the toner adhesion amount calculated for each color, and calculates an image formation condition corresponding to the specific target adhesion amount on the basis of the approximate expression. In step S406, the control part 20 determines the image formation condition calculated in step S405 as the second image formation condition. The specific target adhesion amount is, as described with reference to FIG. 7, an adhesion amount determined for each IDC sensor in step S310 (FIG. 3) of the first toner adhesion amount adjustment process.

Figure 9:
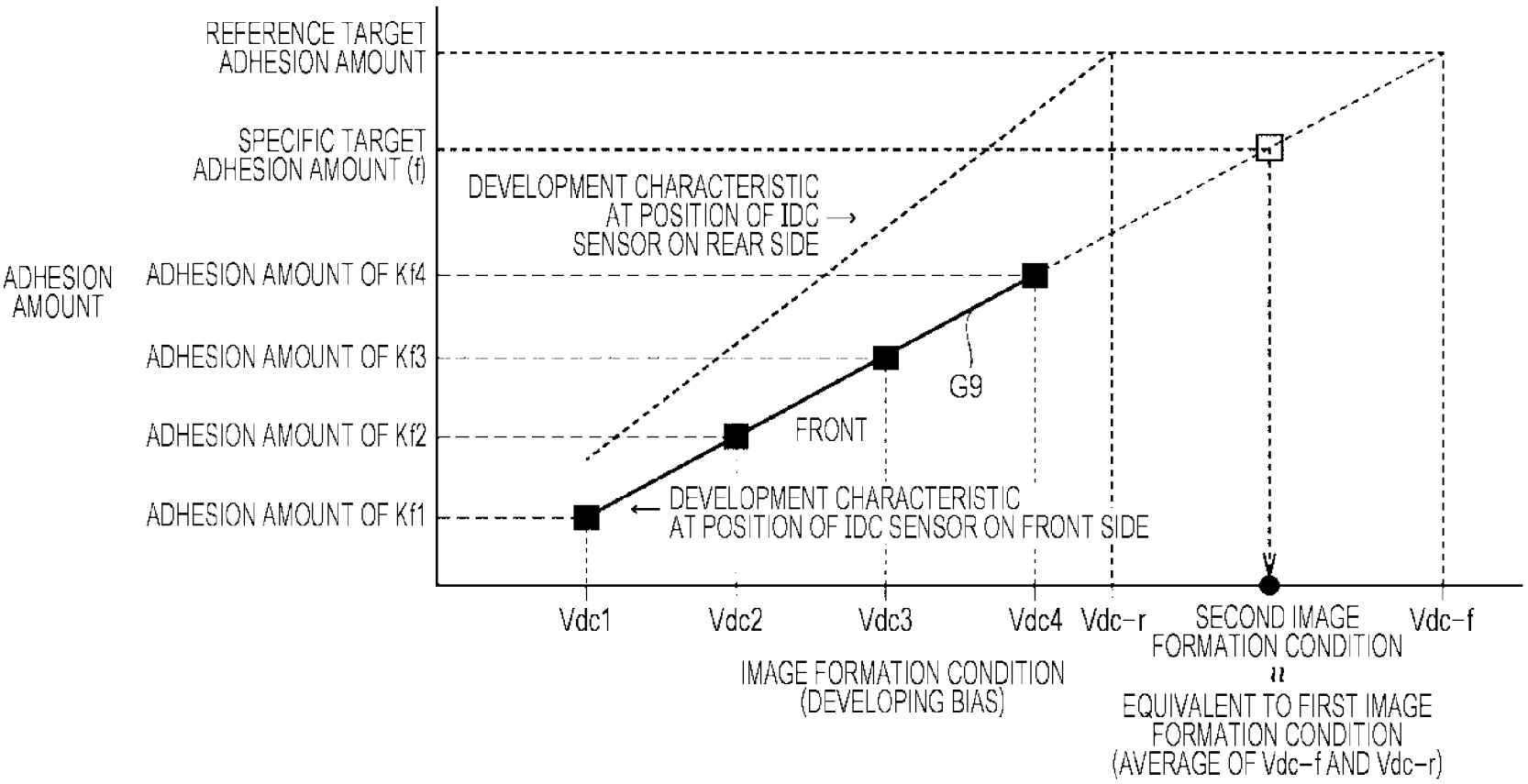
FIG. 9 is a graph for explaining determination of a second image formation condition with use of a toner adhesion amount in steps S405 and S406.

FIG. 9 is a graph for explaining determination of the second image formation condition with use of the toner adhesion amount in steps S405 and S406. A horizontal axis and a vertical axis of the graph of FIG. 9 indicate a developing bias and a toner adhesion amount, which are examples of the image formation condition, similarly to the horizontal axis and the vertical axis of the graph of FIG. 3.

FIG. 9 shows adhesion amounts of the respective four toner patterns Kf1 to Kf4 out of the sixteen toner patterns of FIG. 8. Each adhesion amount is calculated from the reflection density of each toner pattern. In step S405, the control pan 20 generates an approximate expression representing a relationship between the image formation condition (developing bias in the example of FIG. 9) and the toner adhesion amount for each color, and calculates an image formation condition corresponding to the obtained specific target adhesion amount in accordance with the approximate expression. In step S406, the control part 20 determines the image formation condition calculated in step S405 as the second image formation condition. In the example of FIG. 9, a line G9 is shown as the approximate expression, but the approximate expression is not limited to a linear expression.

The control part 20 uses the second image formation condition determined in step S406 to adjust an image formation condition to be used as a reference for image formation in the image forming apparatus 1. For this adjustment, for example, the target adhesion amount storage part 33 stores a reference image formation condition as the image formation condition corresponding to the reference target adhesion amount. The control part 20 compares the second image formation condition determined as described above and the reference image formation condition, and uses a result of the comparison to determine a coefficient to be applied to the image formation condition associated with the target toner adhesion amount. In one example, the control part 20 calculates a ratio of the second image formation condition to the reference image formation condition. Then, in the image formation, the control part 20 adjusts the toner adhesion amount by using, for each of the toner patterns Kr1 to Kr4 and Kf1 to Kf4, a value obtained by multiplying each of the preset developing biases Vdc1 to Vdc4 by the ratio. Then, the control part 20 ends the processing of FIG. 3.

In the processing of FIG. 3 described above, when the processing of FIG. 3 is started, the first toner adhesion amount adjustment process (steps S301 to S313) is executed when the predetermined timing has arrived, and the second toner adhesion amount adjustment process (steps S401 to S406) is executed when the predetermined timing has not arrived. In the first toner adhesion amount adjustment process, the first sample image 400 is used, so that both the IDC sensors 19*f* and 19*r* are used for each color. In the second toner adhesion amount adjustment process, the second sample image 800 is used, so that either one of the IDC sensors 19*f* or 19*r* is used for each color. In the second toner adhesion amount adjustment process, an amount of the toner pattern to be read is smaller than that in the first toner adhesion amount adjustment process. As a result, the second toner adhesion amount adjustment process requires shorter time than the first toner adhesion amount adjustment process.

One example of the predetermined timing is timing at which the processing of FIG. 3 is executed for the first time after at least one of the photoreceptors 12Y to 12K is replaced in the image forming apparatus 1. Another example is timing at which the processing of FIG. 3 is executed for the first time after the intermediate transfer belt 16 is replaced. Tinting of replacement of a member in the image forming apparatus 1 may be detected by a sensor, or may be detected by an input of information indicating that a member has been replaced, from a user.

Yet another example of the predetermined timing is timing at which the processing of FIG. 3 is executed for the first time after at least one of the photoreceptors 12Y to 12K has been used for developing a predetermined number of pages. The control part 20 may change the change of the predetermined timing in accordance with an accumulated value of the number of pages (accumulated number of pages) for which each of the photoreceptors 12Y to 12K has been used for development. For example, each time the accumulated number of pages of the photoreceptors 12Y to 12K reaches a certain amount, the control part 20 may change the predetermined timing so as to increase a frequency for executing the first toner adhesion amount adjustment process when the processing of FIG. 3 is started.

[4] Abnormality of IDC Sensor

The control pan 20 may determine that a state of the IDC sensor is abnormal when the IDC sensor abnormality determination part 40 determines that the reflection density detected by either one of the IDC sensors 19*f* or 9*r* is out of a predetermined range that has been determined as the reflection density of the toner pattern in advance. When determining that either one of the IDC sensors 19*f* or 19*r* is abnormal, the control part 20 may execute the second toner adhesion amount adjustment process even if the predetermined timing for executing the first toner adhesion amount adjustment process has arrived. In this second toner adhesion amount adjustment process, a sensor that is not determined to be abnormal is used. In a sample image to be used, a toner pattern is arranged such that a reflection density is detected by a sensor that is not determined to be abnormal.

Figure 10:
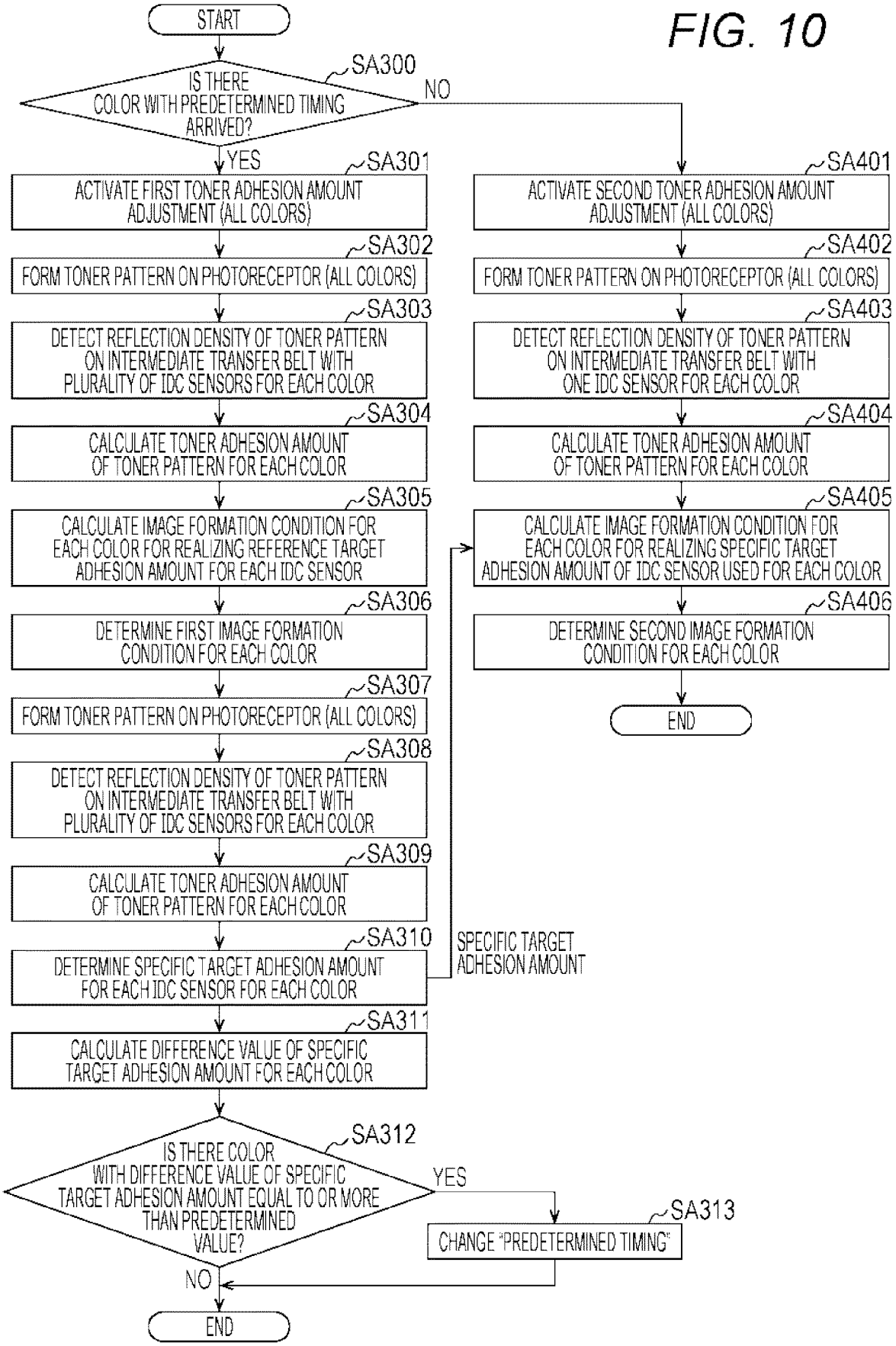
FIG. 10 is a flowchart showing a modification of the operations shown in FIG. 3.

[5] Adjustment when Arrival of Predetermined Timing Differs Between Image Forming Units of Plurality of Colors FIG. 10 is a flowchart showing a modification of the operations shown in FIG. 3. In the operations shown in FIG. 10, it is considered that the arrival timing of the predetermined timing (step S300) is different for each of the image forming units 60Y to 60K of a plurality of colors.

The control part 20 starts processing of FIG. 10, for example, at fixed time intervals. In FIG. 10, for each step in FIG. 3 such as step S300, the letter "A" is added such as step SA300.

In step SA300, the control part 20 determines whether or not a predetermined timing has arrived for each color. One example of the predetermined timing in step SA300 is timing at which the processing of FIG. 10 is executed for the first time after replacement of each of the photoreceptors 12Y, 12M, 12C, and 12K.

When the predetermined timing has arrived for at least one color (YES in step SA300), the control part 20 advances the control to step SA301 to execute a first toner adhesion amount adjustment process. Otherwise (NO in step SA300), the control part 20 advances the control to step SA401 to execute a second toner adhesion amount adjustment process. In the example of FIG. 10, the "first toner adhesion amount adjustment process" is configured under the control of steps SA301 to SA313, and the "second toner adhesion amount adjustment process" is configured under the control of steps SA401 to SA406.

[5-1] First Toner Adhesion Amount Adjustment Process

In step SA301, the control part 20 activates the first toner adhesion amount adjustment part 34 for all the colors (Y, M, C, and K).

In step SA302, the control part 20 (first toner adhesion amount adjustment part 34) causes the image processing part 10 to form a first sample image (FIG. 4) on the photoreceptors 12Y to 12K.

In step SA303, the control part 20 (first image formation condition determination part 35) reads each toner pattern of the first sample image 400 formed on the intermediate transfer belt 16, with use of the IDC sensors 19*f* and 19*r*. As a result, reflection densities of the toner patterns of a plurality of densities (densities 1 to 4) re detected by both the IDC sensor 19*f* and the IDC sensor 19*r*, for all the colors.

In step SA304, the control part 20 (toner adhesion amount calculation part 25) calculates a toner adhesion amount (t ($g/m^2$)) of each toner pattern on the basis of the reflection density detected in step SA303.

In step SA305, the control part 20 determines an image formation condition corresponding to the reference target adhesion amount for each color.

In step SA306, the control part 20 determines the first image formation condition for each color with use of the image formation condition determined in step SA305. The control part 20 uses the first image formation condition determined in step SA306 to adjust each image formation condition to be used as a reference for image formation of each color in the image firming apparatus 1.

In step SA307, the control part 20 (first toner adhesion amount adjustment part 34) reads toner pattern data for toner adhesion amount adjustment and the first image formation condition, from the toner pattern storage part 26 through the specific target adhesion amount determination part 36, and causes the image processing part 10 to form a sample image (FIG. 6) on the intermediate transfer belt 16 under the first image formation condition. As a result, for all the colors, there is formed an image of two toner patterns (for the IDC sensor 19*f* and for the IDC sensor 19*r*) according to the first image formation condition.

In step SA308, the control part 20 (specific target adhesion amount determination part 36) causes the IDC sensors 19*f* and 19*r* to detect reflection densities of the respective toner patterns in the sample image formed in step SA307.

In step SA309, on the basis of the reflection density detected in step SA308, the control part 20 (specific target adhesion amount determination part 36) calculates a toner adhesion amount (t ($g/m^2$)) of each toner pattern.

In step SA310, the control part 20 (specific target adhesion amount determination pan 36) determines the toner adhesion amount calculated in step SA309 as the specific target adhesion amount of each color, and stores the determined individual target adhesion amounts, in the target adhesion amount storage part 33.

In step SA311, for each color, the control part 20 calculates a difference value between the specific target adhesion amounts for the respective IDC sensors determined in step SA310 (a difference value between the specific target adhesion amount determined for the IDC sensor 19*r* and the specific target adhesion amount determined for the IDC sensor 191).

In step SA312, the control part 20 determines whether or not the difference value calculated in step SA311 for at least one color is equal to or more than a predetermined value. Upon determining that the difference value is equal to or more than a predetermined value for at least one color (YES in step SA312), the control part 20 advances the control to step SA313, or otherwise (NC) in step SA312) ends the processing of FIG. 10.

In step SA313, the control part 20 changes the "predetermined timing" for the color determined in step SA312 that the difference value is equal to or more than the predetermined value. More specifically, the control part 20 changes the "predetermined timing" in step SA300 so as to increase a frequency for advancing the control from step S300 to step S301.

[5-2] Second Toner Adhesion Amount Adjustment Process

In step SA401, the control part 20 activates the second toner adhesion amount adjustment part 38 that adjusts the second toner adhesion amount for all the colors.

In step SA402, the control part 20 (second toner adhesion amount adjustment part 38) reads toner pattern data for toner adhesion amount adjustment and the image formation condition specified for forming an image of each toner pattern, from the toner pattern storage part 26 through the second image formation condition determination part 39. Then, the second toner adhesion amount adjustment part 38 causes the image processing part 10 to form the read toner pattern on the photoreceptors 12Y to 12K, under the read image formation condition. As a result, a second sample image (FIG. 8) is formed.

In step SA403, the control part 20 (second image formation condition determination part 39) reads each toner pattern of the second sample image 800 formed on the intermediate transfer belt 16, with use of the IDC sensors 19*f* and 19*r*. The IDC sensors 19*f* and 19*r* detect reflection densities of the toner images of the respective toner patterns, and input to the control part 20. Note that, in step SA403, for each color, the refection density is detected exclusively by either one of the IDC sensor 19*f* or the IDC sensor 19*r*.

In step SA404, the control part 20 (toner adhesion amount calculation part 25) calculates a toner adhesion amount (t ($g/m^2$)) of each toner pattern on the basis of the reflection density detected in step SA403.

In step SA405, the control part 20 generates an approximate expression from the toner adhesion amount calculated for each color, and calculates an image formation condition corresponding to the specific target adhesion amount on the basis of the approximate expression. In step SA406, the control part 20 determines the image formation condition calculated in step SA405 as the second image formation condition for each color.

The control part 20 uses the second image formation condition determined in step SA406 to adjust each image formation condition to be used as a reference for image formation of each color in the image forming apparatus 1. Then, the control part 20 ends the processing of FIG. 10.

[5-3] Predetermined Timing and Execution Frequency of First (Second) Toner Adhesion Amount Adjustment Process In the processing of FIG. 10 described above, as long as the predetermined timing has arrived for at least one color in step SA300, the control part 20 executes the first toner adhesion amount adjustment process for all the colors (steps SA301 to SA313). That is, even if the predetermined timing has not arrived for a certain color, the first toner adhesion amount adjustment process is executed for all the colors as long as the predetermined timing has arrived for another color. The fact that the arrival of the predetermined timing differs for each color will be described more specifically with reference to FIG. 11.

Figure 11:
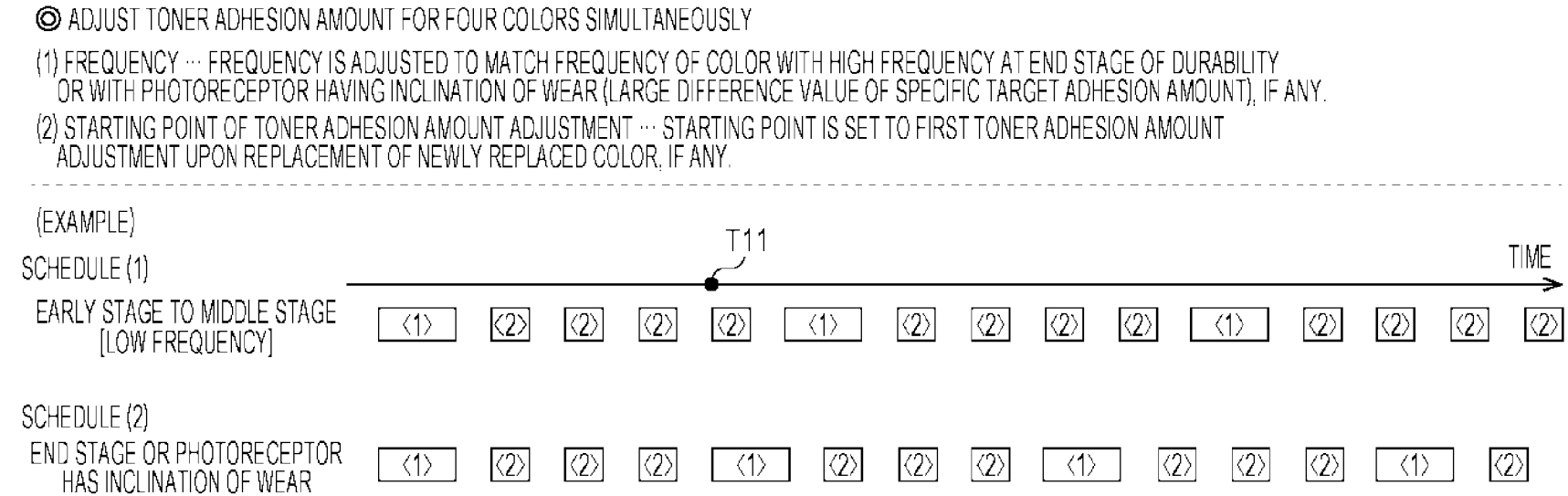
FIG. 11 is a view for explaining two types of predetermined timings.

FIG. 11 is a view for explaining two types of predetermined timings. FIG. 11 is a view showing one example of the two types of execution schedules (schedule (1) and schedule (2)) of toner adhesion amount adjustment process. In FIG. 11, a horizontal axis indicates lapse of time. "<1>" indicates a period during which execution of the first toner adhesion amount adjustment process is scheduled. "<2>" indicates a period during which execution of the second toner adhesion amount adjustment process is scheduled. The reason why "<1>" takes a longer time than "<2>" is that more toner pattern adhesion amounts are required to be calculated in the first toner adhesion amount adjustment process than that in the second toner adhesion amount adjustnment process.

In the example of FIG. 11, in schedule (1), a pattern is repeated in which four "<2>" are arranged after one "<1>". That is, schedule (1) indicates a state where, as the predetermined timing, it is set that the second toner adhesion amount adjustment process is executed for four times after the first toner adhesion amount adjustment process is executed in the previous processing of FIG. 3 (or FIG. 10).

In schedule (2), a pattern is repeated in which three "<2>" are arranged after one "<1>". That is, schedule (2) indicates a state where, as the predetermined timing, it is set that the second toner adhesion amount adjustment process is executed for three times after the first toner adhesion amount adjustment process is executed in the previous processing of FIG. 3 (or FIG. 10).

In schedule (1), the first toner adhesion amount adjustment process is executed for one time while the control of FIG. 3 (or FIG. 10) is executed for five times. In schedule (2), the first toner adhesion amount adjustment process is executed for one time while the control of FIG. 3 (or FIG. 10) is executed for four times. Therefore, the first toner adhesion amount adjustment process is executed more frequently in schedule (2) than in schedule (1).

In step SA313, the frequency for executing the first toner adhesion amount adjustment process is changed for each color by changing the "predetermined timing". Therefore, while the "predetermined timing" is set so as to correspond to schedule (1) for three colors (Y, M, and C) in the image forming apparatus 1, the "predetermined timing" may be set so as to correspond to schedule (2) for one color (K).

Even in such a case, in the processing of FIG. 10, as long as the first toner adhesion amount adjustment process is to be executed for at least one color due to arrival of the predetermined timing, the control part 20 executes the first toner adhesion amount adjustment process for all the colors. More specifically, at time T11 in FIG. 11, it is the timing at which the second toner adhesion amount adjustment process is to be executed for the color of schedule (1), but it is the timing at which the first toner adhesion amount adjustment process is to be executed for the color of schedule (2). Therefore, the control part 20 executes the first toner adhesion amount adjustment process.

Figure 12:
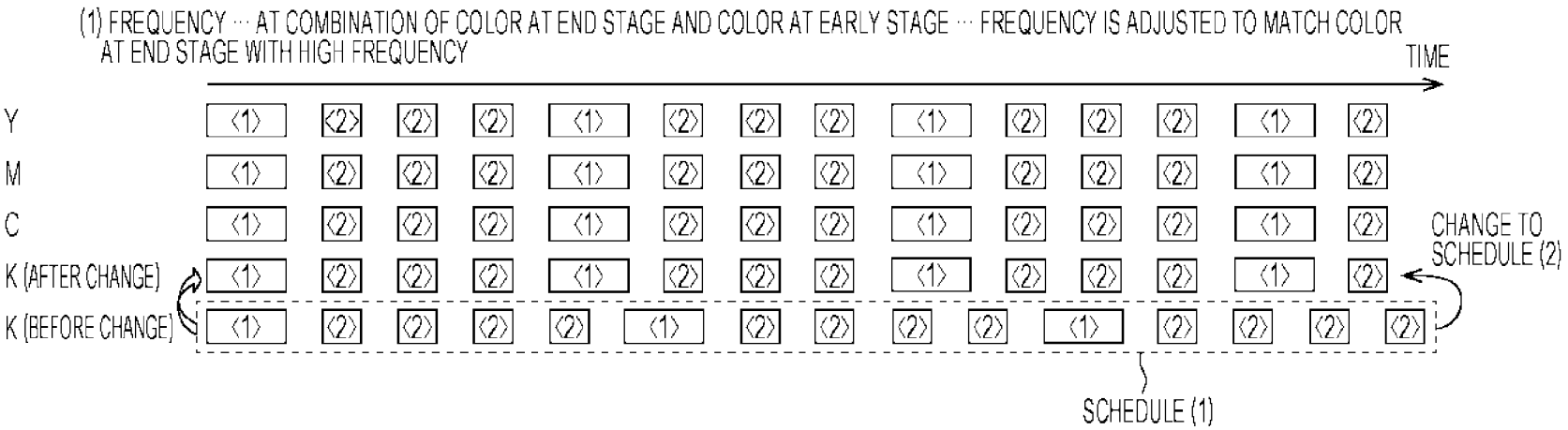
FIG. 12 is a view showing another example of schedule adjustment for execution of a toner adhesion amount adjustment process.

FIG. 12 is a view showing another example of schedule adjustment for execution of a toner adhesion amount adjustment process. In the example of FIG. 12, the setting of the "predetermined timing" corresponds to schedule (1) (FIG. 11) for three colors (Y, M, and C), while the setting of the "predetermined timing" corresponds to schedule (2) (FIG. 11) for one color (K). In such a case, the control part 20 may change the "predetermined timing" so as to match the schedule for a color with a lower execution frequency of the first toner adhesion amount adjustment process with the schedule of a color with higher execution frequency of the first toner adhesion amount adjustment process.

That is, in the example of FIG. 12, the control part 20 changes the setting of the "predetermined timing" for black (K) from one corresponding to schedule (1) to one corresponding to schedule (2), to match with the other three colors.

Figure 13:
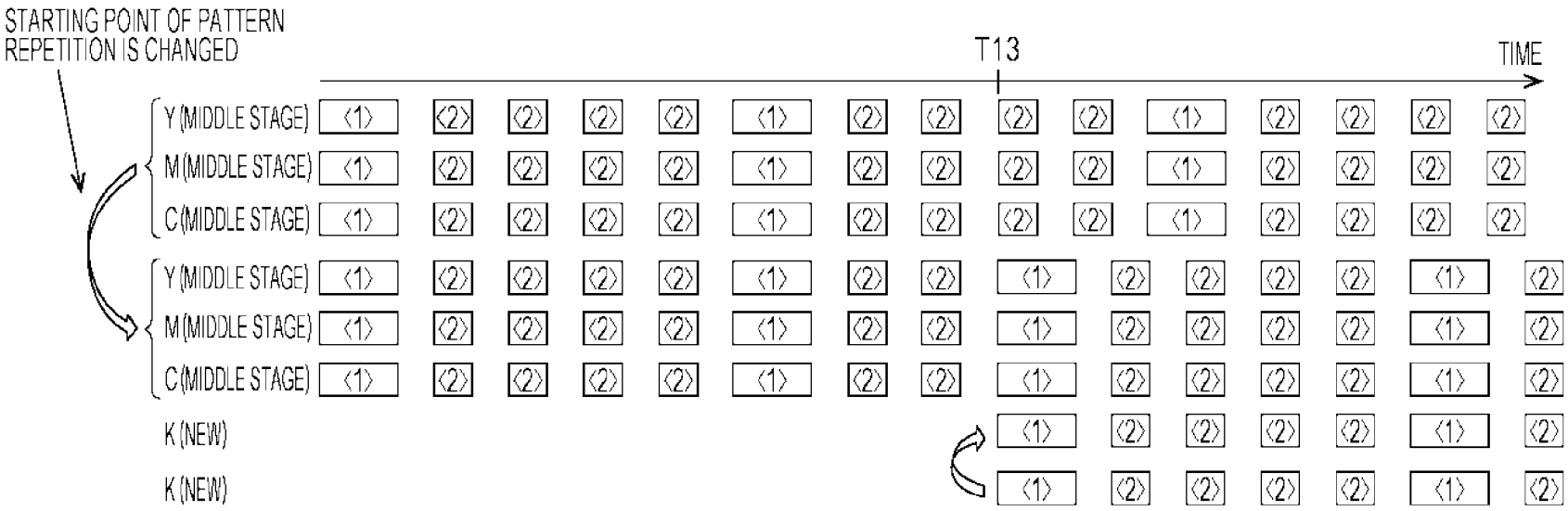
FIG. 13 is a view showing still another example of schedule adjustment for execution of the toner adhesion amount adjustment process.

FIG. 13 is a view showing still another example of schedule adjustment for execution of the toner adhesion amount adjustment process. In the example of FIG. 13, in response a pattern being reset in a schedule for a certain color, the control part 20 simultaneously resets a pattern in a schedule of other colors.

More specifically, in the example of FIG. 13, the execution pattern of the first toner adhesion amount adjustment process and the second toner adhesion amount adjustment process is repeated until time T3 for three colors (Y, M, and C), in accordance with schedule (1) (FIG. 11).

At time T13, due to replacement or the like of the photoreceptor 12K for another one color (K), the control part 20 resets the execution pattern according to schedule (1) for the color (K). The control part 20 also resets the execution patterns for the other three colors (Y, M, and C) along with the resetting of the execution pattern for the color (K).

[6] Summary of Disclosure

An outline of the image forming apparatus 1 according to an embodiment of the present disclosure is as follows.

(1) The image forming apparatus 1 includes an image forming part (image processing part 10) that forms a toner image on a recording medium, and a control part (control part 20) that controls the image firming part.

The image forming part includes an image carrier (intermediate transfer belt 16, photoreceptors 12Y to 12K), forms a toner image on the image carrier, and forms a toner image on a recording medium by transferring the image on the image carrier onto the recording medium. The control part uses a first image formation condition determined in accordance with toner adhesion amounts at a plurality of points in a first direction (main scanning direction) on the image carrier, to execute a first adjustment process (first toner adhesion amount adjustment process) of adjusting the image forming part. The control part uses a second image formation condition determined in accordance with a toner adhesion amount at one point in the first direction on the image carrier, to execute a second adjustment process (second toner adhesion amount adjustment process) of adjusting the image forming part. The image carrier rotates as the recording medium is conveyed. The first direction (the direction of the arrow A in FIG. 1) is a direction intersecting with a rotational direction of the image carrier.

In the first adjustment process, the first image formation condition is determined as a condition for realizing a given toner adhesion amount (FIG. 5), and a specific target adhesion amount is determined as a toner adhesion amount at one point when the image forming part is adjusted in accordance with the first image formation condition (FIG. 7). In the second adjustment process, the second image formation condition is determined as a condition for setting the toner adhesion amount at one point to the specific target adhesion amount (FIG. 9). Upon arrival of timing at which the image forming part is to be adjusted (at the start of the process in FIG. 3), the control part executes the first adjustment process when the predetermined condition is satisfied (YES in step S300, step S301), and executes the second adjustment process when the predetermined condition is not satisfied (NO in step S300, step S401).

(2) In the first adjustment process, for each of the plurality of points, with use of a correlation (the line G1 or the line G2 in FIG. 5) between a plurality of image formation conditions and a toner adhesion amount according to each of the plurality of image formation conditions, an image formation condition for realizing a given toner adhesion amount may be determined, and the first image formation condition may be determined as an average value of image formation conditions (Vdc-f, Vdc-r) determined for the respective plurality of points.

(3) in the first adjustment process, for one point, the specific target adhesion amount may be determined as the toner adhesion amount to be realized in accordance with the first image formation condition, with use of a correlation (the line G1 or the line G2 in FIG. 7) between a plurality of image formation conditions and a toner adhesion amount according to each of the plurality of image formation conditions.

(4) In the second adjustment process, for one point, the second image formation condition may be determined as the image formation condition for realizing the specific target adhesion amount, with use of a correlation (the line G9 in FIG. 9) between a plurality of image formation conditions and a toner adhesion amount according to each of the plurality of image formation conditions.

(5) The predetermined condition may include first arrival of the timing at which the image forming part is to be adjusted after the image carrier has been replaced.

(6) The predetermined condition may include first arrival of the timing at which the image forming part is to be adjusted (the start of the processing of FIGS. 3 and 10) after the image forming operation using the image carrier has been executed for a given amount or more. The predetermined condition may be updated so as to increase the execution frequency of the first adjustment process at a time of arrival of the timing at which the image forming part is to be adjusted, as the accumulated amount of the image forming operation using the image carrier increases.

(7) The image forming apparatus 1 may further include a plurality of sensors (IDC sensors 19*f* and 19*r*) that detect a physical quantity for acquiring a toner adhesion amount at each of the plurality of points in the first direction. For each of the plurality of points, the first adjustment process may determine specific target adhesion amounts (specific target adhesion amounts (t) and (r) in FIG. 7). The predetermined condition is changed so as to increase the execution frequency of the first adjustment process at a time of arrival of the timing at which the image forming part is to be adjusted when a difference value between the specific target adhesion amounts determined for the respective plurality of points becomes equal to or more than a predetermined amount (steps S313 and SA313).

(8) The image forming part may form an image of a plurality of colors (Y, M. C, and K), and the control part may execute the first adjustment process when the predetermined condition is satisfied for at least one of the plurality of colors (YES in step SA300, step SA301).

(9) The image forming apparatus 1 may further include a plurality of sensors (IDC sensors 19*f* and 19*r*) that detect a physical quantity for acquiring a toner adhesion amount at each of the plurality of points in the first direction. When a toner adhesion amount acquired from a detection value of a first sensor among the plurality of sensors is out of a predetermined range, the control part may execute the second adjustment process even when the predetermined condition is satisfied ([4] Abnormality of IDC Sensor). At one point in the second adjustment process, a physical quantity is detected by a sensor other than the first sensor among the plurality of sensors.

Although embodiments of the present invention have been described and illustrated in detail, the disclosed embodiments are made for purposes of illustration and example only and not limitation. The scope of the present invention should be interpreted by terms of the appended claims, and it is intended to include all modifications within the meaning and scope equivalent to the claims. In addition, the invention described in the embodiment and each modification is intended to be implemented either individually or in combination, as much as possible.

What is claimed is:

1. An image forming apparatus comprising:

an image forming part that forms a toner image on a recording medium; and a hardware processor that controls the image forming part, wherein the image forming part includes an image carrier, forms a toner image on the image carrier, and forms a toner image on the recording medium by transferring an image on the image carrier onto the recording medium, the hardware processor executes:

a first adjustment process of adjusting the image forming part with use of a first image formation condition determined in accordance with a toner adhesion amount at a plurality of points in a first direction on the image carrier; and a second adjustment process of adjusting the image forming part with use of a second image formation condition determined in accordance with a toner adhesion amount at one point in the first direction on the image carrier, the image carrier rotates as a recording medium is conveyed, the first direction is a direction intersecting with a rotational direction of the image carrier, in the first adjustment process, the first image formation condition is determined as a condition for realizing a given toner adhesion amount, and a specific target adhesion amount is determined as a toner adhesion amount at the one point when the image forming part is adjusted in accordance with the first image formation condition, in the second adjustment process, the second image formation condition is determined as a condition for setting a toner adhesion amount at the one point to the specific target adhesion amount, and at a time of arrival of timing at which the image forming part is to be adjusted, the hardware processor executes the first adjustment process when a predetermined condition is satisfied, and executes the second adjustment process when the predetermined condition is not satisfied.

2. The image forming apparatus according to claim 1, wherein in the first adjustment process:

an image formation condition for realizing the given toner adhesion amount is determined for each of the plurality of points, with use of a correlation between a plurality of image formation conditions and a toner adhesion amount according to each of the plurality of image formation conditions; and the first image formation condition is determined as an average value of image formation conditions determined for the respective plurality of points.

3. The image forming apparatus according to claim 1, wherein in the first adjustment process, for the one point, the specific target adhesion amount is determined as a toner adhesion amount to be realized in accordance with the first image formation condition, with use of a correlation between a plurality of image formation conditions and a toner adhesion amount according to each of the plurality of image formation conditions.

4. The image forming apparatus according to claim 1, wherein in the second adjustment process, for the one point, the second image formation condition is determined as an image formation condition for realizing the specific target adhesion amount, with use of a correlation between a plurality of image formation conditions and a toner adhesion amount according to each of the plurality of image formation conditions.

5. The image forming apparatus according to claim 1, wherein the predetermined condition includes first arrival of timing at which the image forming part is to be adjusted after the image carrier has been replaced.

6. The image forming apparatus according to claim 1, wherein the predetermined condition includes first arrival of timing at which the image forming part is to be adjusted after an image forming operation using the image carrier has been executed for a given amount or more, and the predetermined condition is updated to increase an execution frequency of the first adjustment process at a time of arrival of timing at which the image forming part is to be adjusted, as an accumulated amount of an image forming operation using the image carrier increases.

7. The image forming apparatus according to claim 1, wherein in each of the plurality of points in the first direction, each of a plurality of sensors detects a physical quantity for acquiring a toner adhesion amount, the first adjustment process determines the specific target adhesion amount for each of the plurality of points, and the predetermined condition is changed to increase an execution frequency of the first adjustment process at a time of arrival of timing at which the image forming part is to be adjusted when a difference value between the specific target adhesion amounts determined for the respective plurality of points becomes equal to or more than a predetermined amount.

8. The image forming apparatus according to claim 1, wherein the image forming part forms an image of a plurality of colors, and the hardware processor executes the first adjustment process when the predetermined condition is satisfied for at least one of the plurality of colors.

9. The image forming apparatus according to claim 1, wherein in each of the plurality of points in the first direction, each of a plurality of sensors detects a physical quantity for acquiring a toner adhesion amount, when a toner adhesion amount acquired from a detection value of a first sensor among the plurality of sensors is out of a predetermined range, the hardware processor executes the second adjustment process even when the predetermined condition is satisfied, and at the one point in the second adjustment process, a physical quantity is detected by a sensor other than the first sensor among the plurality of sensors.

10. A non-transitory recording medium storing a computer readable program executed by a computer that controls an image forming part that forms a toner image on a recording medium, the image forming part including an image carrier, forming a toner image on the image carrier, and forming a toner image on the recording medium by transferring an image on the image carrier onto the recording medium, the computer readable program causing the computer to perform:

adjusting the image forming part, by a first adjustment process, with use of a first image formation condition determined in accordance with a toner adhesion amount at a plurality of points in a first direction on the image carrier; and adjusting the image forming part, by a second adjustment process, with use of a second image formation condition determined in accordance with a toner adhesion amount at one point in the first direction on the image carrier, wherein the image carrier rotates as a recording medium is conveyed, the first direction is a direction intersecting with a rotational direction of the image carrier, in the first adjustment process, the first image formation condition is determined as a condition for realizing a given toner adhesion amount, and a specific target adhesion amount is determined as a toner adhesion amount at the one point when the image forming part is adjusted in accordance with the first image formation condition, in the second adjustment process, the second image formation condition is determined as a condition for setting a toner adhesion amount at the one point to the specific target adhesion amount, and at a time of arrival of timing at which the image forming part is to be adjusted, the computer readable program causes the computer to execute the adjusting of the image forming part with use of the first image formation condition when a predetermined condition is satisfied, and to execute the adjusting of the image forming part with use of the second image formation condition when the predetermined condition is not satisfied.

* * * * *